United States Patent [19]

Ullmann

[11] 4,193,733

[45] Mar. 18, 1980

[54] HYDRAULIC EXCAVATOR MACHINE HAVING SELF-CONTAINED ELECTROHYDRAULIC POWER UNITS

[75] Inventor: Karl H. Ullmann, Dortmund, Fed. Rep. of Germany

[73] Assignee: Harnischfeger Corporation, West Milwaukee, Wis.

[21] Appl. No.: 906,983

[22] Filed: May 17, 1978

[51] Int. Cl.[2] ..... E02F 9/22

[52] U.S. Cl. ..... 414/694; 60/DIG. 10; 92/146

[58] Field of Search ..... 414/694; 60/477, DIG. 2, 60/DIG. 10; 92/146, 161

[56] References Cited

U.S. PATENT DOCUMENTS

| | | | |
|---|---|---|---|
| 1,690,181 | 11/1928 | Sederholm | 60/474 |
| 2,517,813 | 8/1950 | Wallace | 212/35 HC |
| 2,756,563 | 7/1956 | Bohlman et al. | 60/460 X |
| 3,608,742 | 9/1971 | Adolfsson | 212/35 R |
| 3,840,132 | 10/1974 | Howells et al. | 60/DIG. 2 |
| 3,902,318 | 9/1975 | Becker et al. | 60/DIG. 10 |
| 3,928,969 | 12/1975 | Picker | 60/DIG. 10 |
| 3,940,930 | 3/1976 | Rosander | 60/DIG. 2 |
| 3,979,909 | 9/1976 | Meyer et al. | 60/DIG. 10 |
| 4,041,703 | 8/1977 | Knapp | 60/DIG. 10 |

FOREIGN PATENT DOCUMENTS 1175057 7/1964 Fed. Rep. of Germany .... 60/DIG. 10

*Primary Examiner*—L. J. Paperner
*Attorney, Agent, or Firm*—James E. Nilles

[57] ABSTRACT

A large mobile self-propelled excavator machine comprises an upper section on which a plurality of movable components, such as a boom, stick, and shovel, are mounted. A plurality of self-contained independently operable electrohydraulic power units are provided, one for each movable component, and each power unit comprises a housing, a pair of hydraulic rams mounted on the housing, means for pivotally connecting the housing and the ram piston rods to their associated components, a fluid reservoir in the housing, a reversible main pump in the reservoir for supplying the rams, auxiliary pumps on the housing, an electric motor on the housing for driving the pumps, and solenoid valve control means on the main pump. Each power unit is supplied with electric power for its electric motor by a cable from a generator on the upper section of the excavator machine. The solenoid valve control means on each main pump is operatively connected by a cable to the operator's control station on the upper section of the excavator machine.

12 Claims, 11 Drawing Figures

HYDRAULIC EXCAVATOR MACHINE HAVING SELF-CONTAINED ELECTROHYDRAULIC POWER UNITS

BACKGROUND OF THE INVENTION

1. Field of Use

This invention relates generally to hydraulic excavator machines or the like having pivotally movable components and to self-contained electrohydraulic individual power units for driving the components.

2. Description of the Prior Art

Large excavating machines, such as hydraulic mining shovels or the like, typically comprise a self-propelled carrier having driven and steerable crawler tracks and a horizontally rotatable upper section is mounted on the carrier. A boom is pivotally mounted on the carrier, a stick is pivotally mounted on the boom, a shovel is pivotally mounted on the stick, and double-acting hydraulic cylinders are provided for moving the boom, stick, and shovel. Typically, the boom cylinder is pivotally connected between the frame of the upper section and the boom to operate the latter; the stick cylinder is pivotally connected between the boom and the stick to operate the latter, and the shovel cylinder is pivotally connected between the stick and the shovel to operate the latter. Heretofore, the hydraulic fluid for operating these cylinders was supplied by an internal combustion engine-driven main hydraulic pump which was mounted on the upper section. Hydraulic fluid was carried between the main pump and the individual cylinders, as required, through large flexible high pressure fluid carrying hoses extending between the cylinder and the main pump, and the necessary valving was located either on the upper section of the machine, or, when necessary, on the individual cylinders. In some cases, control valves located on the cylinders required additional control fluid hoses or lines, or, if solenoid-operated, required electrical control wires.

Presently, excavating machines are required which are substantially larger and heavier and have a greater load-carrying capacity than was formerly the case. For example, some excavating machines weigh 662,000 pounds and require a hydraulic power rating of 1,000 horsepower with hydraulic fluid being supplied at pressures up to 4,350 psi at flow rates of up to 423 gallons per minute. In such machines, it is necessary to use very large valves, pipes, and fluid hoses between the hydraulic cylinders and the main pump and this becomes very complex and costly. In some instances, hoses having flexible reinforced coverings, valves, and piping are not obtainable in the sizes as large as required, or, if obtainable, are extremely expensive and are not sufficiently reliable in view of the large pressures involved. Furthermore, when hydraulic power, fluid pressure, and rate of fluid flow in large systems exceeds certain values, flow resistance increases at a geometric rate thereby resulting in a net loss of power available at the cylinders and requiring expenditure of greater energy. In addition, in large conventional systems, substantial amounts of energy are required to accelerate, decelerate, reverse, and reaccelerate fluid flow.

The prior art contains examples of a combined motor-driven hydraulic pump and hydraulic cylinder unit which is employed to effect relative movement between two components and U.S. Pat. No. 3,608,742 exemplifies an elementary arrangement which, however, differs from that hereinafter described.

SUMMARY OF THE PRESENT INVENTION

In accordance with the invention, there is provided a large mobile self-propelled hydraulic excavator machine which comprises a lower section having driven and steerable crawler tracks and a horizontally rotatable upper section mounted on the lower section. The upper section carries an engine-driven electric generator, an operator's control station and supports a plurality of relatively movable components such as a boom, a stick, and a shovel or bucket. The boom is pivotally mounted on the upper section, the stick is pivotally mounted on the boom, and the bucket is pivotally mounted on the stick. The boom and stick comprise a pair of spaced apart structural members and the bucket comprises a pair of spaced apart support buckets on the rear thereof. A plurality of self-contained independently operable electrohydraulic power units are provided for moving the components and include a boom power unit, a stick power unit, and a bucket power unit. The boom power unit, located between the structural members of the boom, is pivotally connected between the upper section and the boom. The stick power unit, also located between the structural members of the boom, is pivotally connected between the boom and the stick. The bucket power unit, located between the structural members of the stick, is pivotally connected between the stick and the bucket support brackets.

Each power unit comprises: a housing; a pair of hydraulic rams mounted on the housing, each ram comprising a cylinder, a piston in the cylinder, and a piston rod connected to the piston and extending from the cylinder; and means mounted on the housing and on the piston rods for connecting the power unit to its associated pair of relatively movable components. Each power unit further comprises a fluid reservoir in the housing; a reversible variable displacement hydraulic pump mounted in the reservoir for supplying fluid to operate the hydraulic rams; auxiliary pumps for fluid cooling and fluid makeup mounted on the exterior of the housing; an electric motor mounted on the exterior of the housing and connected to drive the pumps; and control means on the pump for controlling the pump. First means including electric cables are provided for connecting each electric motor to the generator and second means are provided for connecting the control means on each pump to the operator's control station on the upper section. Preferably, the remotely operable means on the pump are electrically actuatable (i.e., solenoid valves) and the second means includes electric cables. Preferably, each ram is of the double-acting equal displacement type. In one embodiment, the electric motor has an axis which is parallel to the longitudinal axis of the rams. In another embodiment, the electric motor has an axis which is transverse to the longitudinal axis of the rams.

An excavator machine in accordance with the present invention offers many advantages over the prior art. For example, by providing individual self-contained electrohydraulic power units for driving each movable component, the extremely large main pump normally mounted on the frame of the upper section of the machine is eliminated. Furthermore, large and redundant heavy-duty high pressure flexible fluid lines heretofore connected between the main pump and the individual hydraulic cylinders for operating the individual components are eliminated. This results in a lighter less complex less costly and more reliable excavator machine. In addition, since each component is operated or driven by its own independent power unit, individual power units requiring servicing can be removed and replaced by substitute power units thereby reducing the down time of the excavating machine and thereby reducing the cost of repairs and service. Use of individual power units in accordance with the invention substantially reduces the horsepower, fluid pressure, and fluid flow rates heretofore required in prior art machines of equivalent size and material-handling capacities, thereby resulting in smaller less costly and more reliable operating elements in the hydraulic system. Power units in accordance with the invention are compact, mechanically strong, and highly efficient and are readily adaptable to modifications in configuration thereby permitting their adaptation and use with various types of excavator machines or other types of machines which have movable components of specialized configuration and design.

Power units of the aforesaid character are especially well adapted for use with extremely large excavating machines of the aforesaid character which have a number of interrelated articulatable and relatively movable components. However, such power units are also advantageously employed with any type of large hydraulically operated machine wherein one component must be moved relative to the machine or to another component. Other objects and advantages of the invention will hereinafter appear.

DESCRIPTION OF PREFERRED EMBODIMENTS

Figure 1:
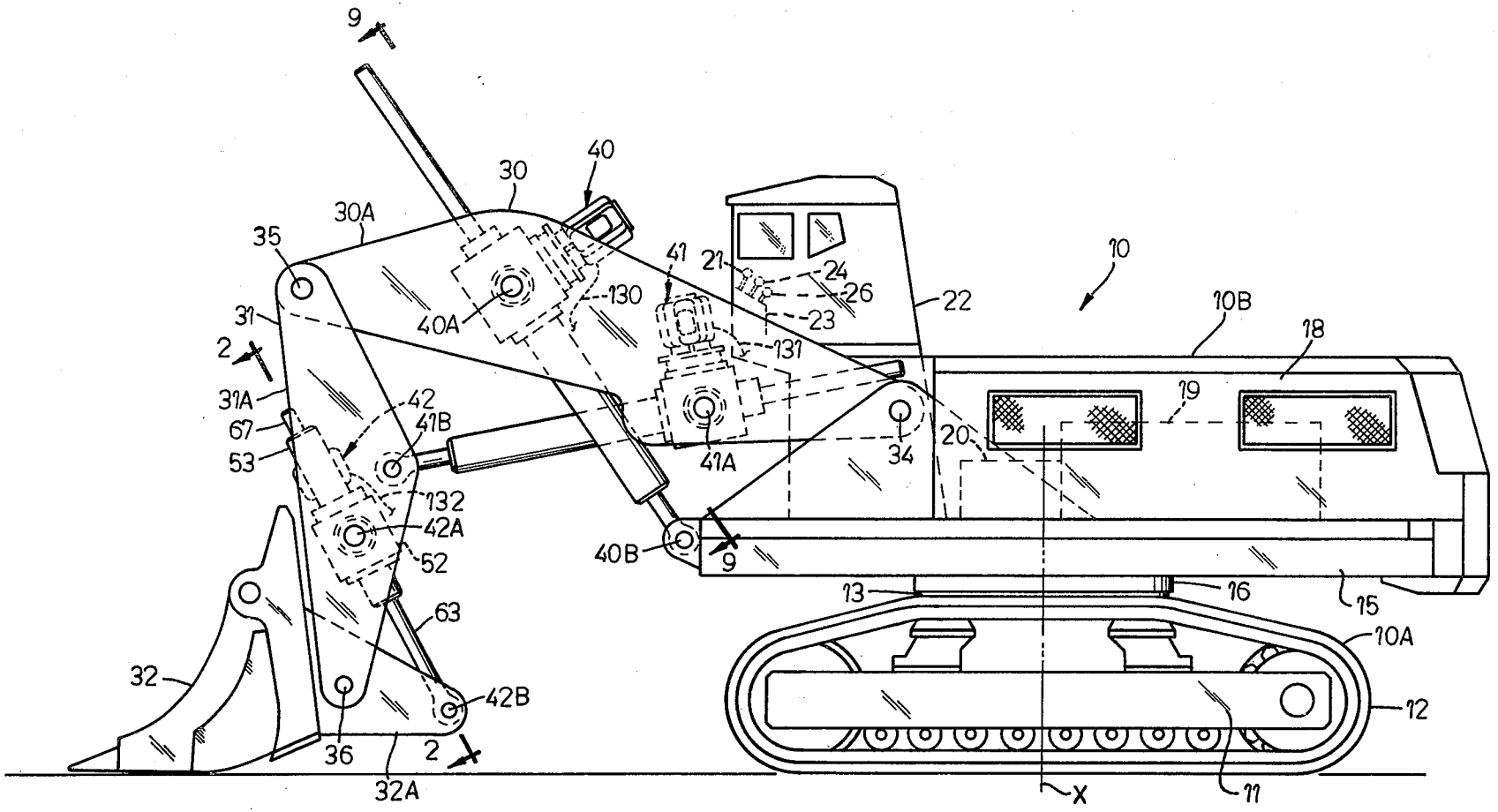
FIG. 1 is a side elevational view of a large hydraulic excavator machine employing a plurality of self-contained electrohydraulic power units in accordance with the invention.
Figure 3:
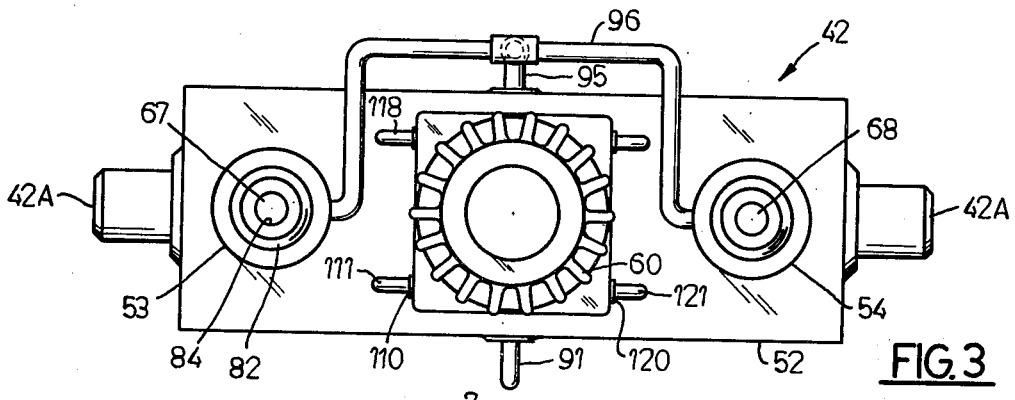
FIG. 3 is an elevational view of the upper end of the power unit shown in FIG. 2.
Figure 2:
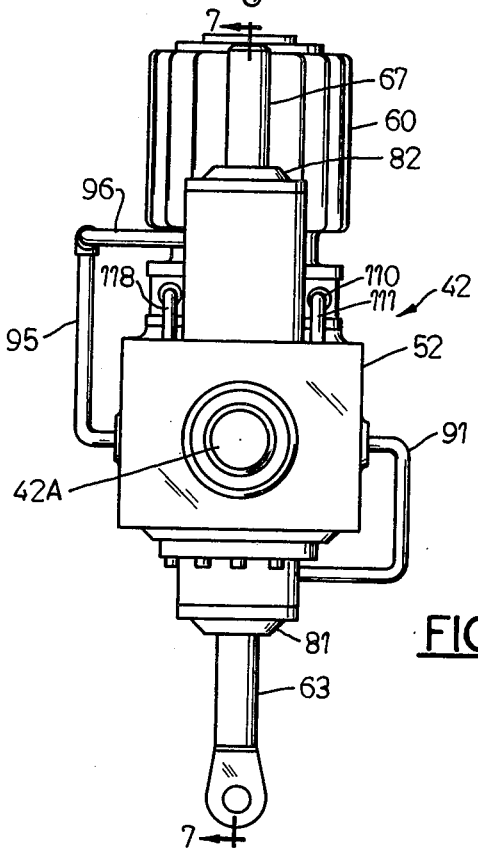
FIG. 2 is an enlarged side elevational view of one of the power units shown in FIG. 1.
Figure 4:
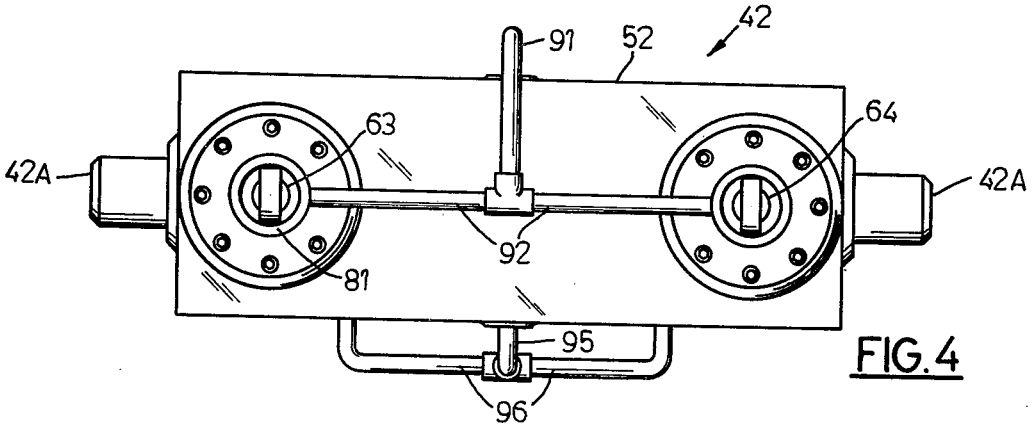
FIG. 4 is an elevational view of the lower end of the power unit shown in FIG. 2.
Figure 5:
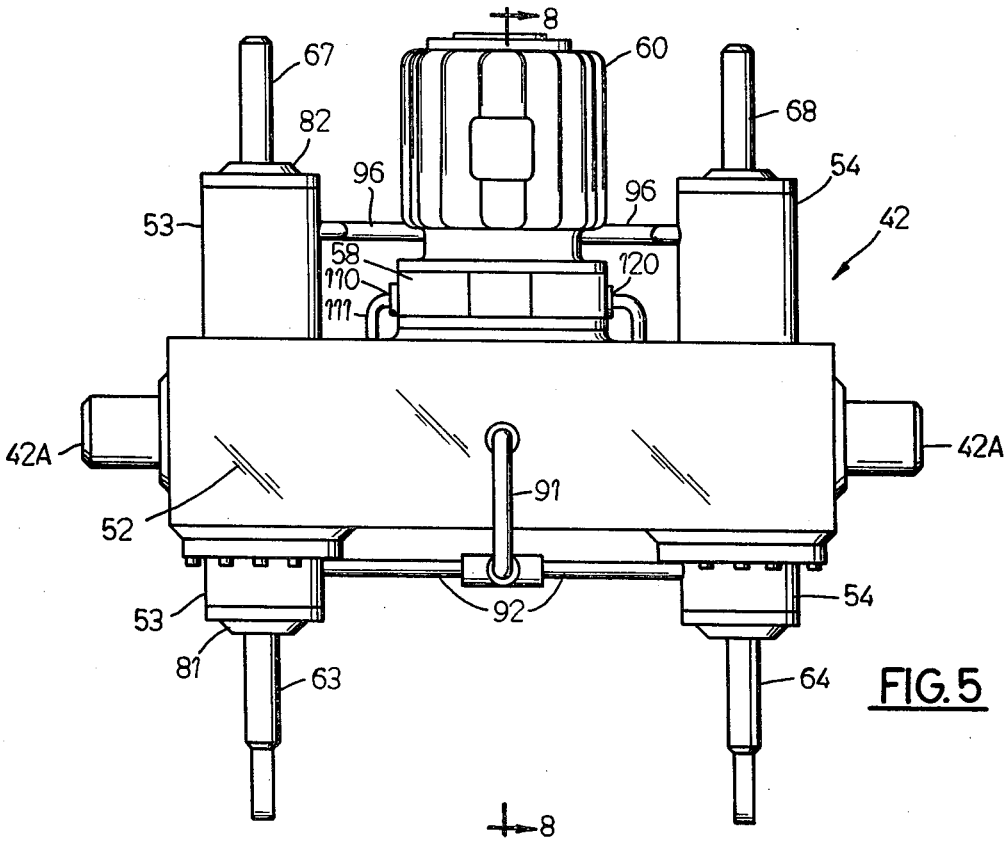
FIG. 5 is a plan view of the upper side of the power unit shown in FIG. 2.
Figure 6:
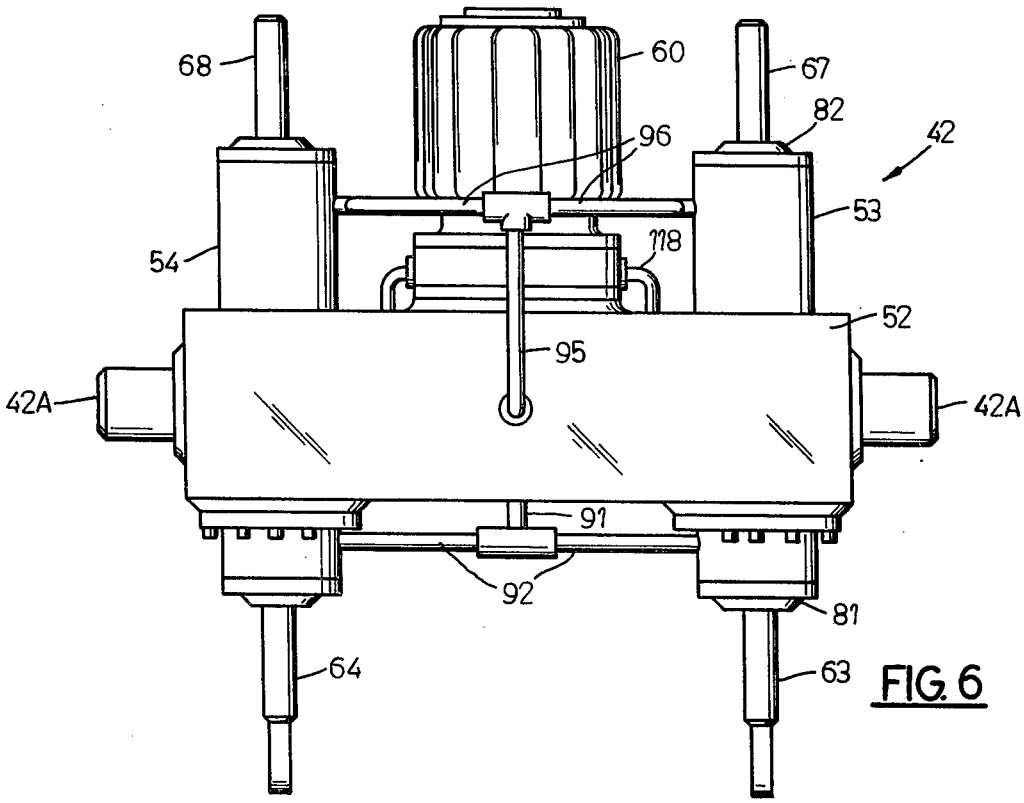
FIG. 6 is a plan view of the lower side of the power unit shown in FIG. 2.

FIG. 1 is a side elevational view of the front end portion of a large mining shovel or excavator 10 in accordance with the invention. Excavator 10 comprises a self-propelled lower section 10A having an upper section 10B mounted thereon which is rotatable in either direction about a vertical axis X. Lower section 10A of excavator 10 comprises a chassis 11 on which a pair of laterally spaced apart ground-engaging independently drivable and steerable conventional crawler tracks 12 and a slew ring 13 are mounted.

Upper section 10B of excavator 10 comprises a frame 15 having mounting means 16 whereby it is rotatably mounted on slew ring 13. Frame 15 supports a machine house 18 in which an internal combustion engine 19 and an electric power generator 20 driven thereby are mounted. Frame 15 also supports an operator's cab 22 in which an operator's control panel 23 is mounted. Control panel 23 is provided with control levers 21, 24, and 26 for power units 40, 41, and 42, respectively, hereinafter described.

Figure 10:
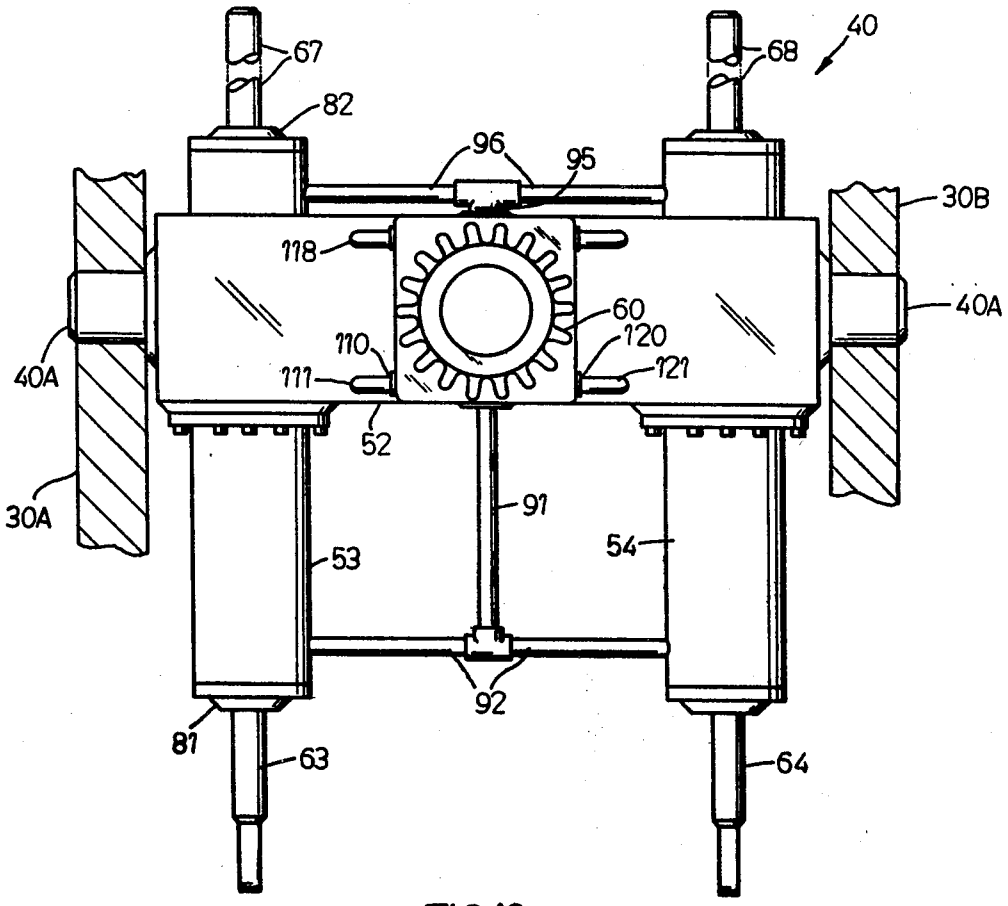
FIG. 10 is a plan view of the upper side of the power unit shown in FIG. 9.

Upper section 10B of excavator 10 also comprises a pivotably movable boom 30, a pivotably movable stick 31, and a pivotably movable shovel or bucket 32. Boom 30 comprises a pair of laterally spaced apart boom members 30A and 30B (see FIG. 10) and stick 31 comprises a pair of laterally spaced apart stick members 31A and 31B (see FIG. 7). Bucket 32 is provided with a pair of laterally spaced apart brackets 32A and 32B on the rear thereof (see FIG. 7). The lower end of boom 30 is pivotally connected by pivot pin means 34 to upper frame 15. The upper end of stick 31 is pivotally connected by pivot pin means 35 to the upper end of boom 30. The bucket 32 comprises the pair of spaced apart attachment brackets 32A and 32B which are pivotally connected by pivot means 36 to the lower end of stick 31.

Means are provided to effect independent pivotal movement of the boom 30, the stick 31, and the shovel 32, and, in accordance with the invention, such means take the form of a plurality of independently operable self-contained electrohydraulic power units, including boom power unit 40, stick power unit 41, and bucket power unit 42, respectively. Power unit 40 is pivotally connected between frame 15 and boom 30 by trunnions 40A and pins 40B. Power unit 41 is pivotally connected between boom 30 and stick 31 by trunnions 41A and pins 41B. Power unit 42 is connected between stick 31 and the brackets 32A and 32B of bucket 32 by trunnions 42A and pins 42B. The power units 40, 41, and 42 are generally similar in construction and mode of operation, except as hereinafter explained, and, therefore, only bucket power unit 42 is hereinafter described in detail.

As FIGS. 1–8 and 11 show, electrohydraulic power unit 42 generally comprises a rigid housing 52, hereinafter described in detail, a pair of trunnions 42A on opposite sides of housing 52 whereby the unit is pivotally mounted on and between the members 31A and 31B of stick 31, a pair of hydraulic cylinders 53 and 54 which are mounted on and extend through housing 52, a main pump 56 (shown in FIGS. 7, 8, and 11) which is mounted within housing 52, auxiliary pumps 58 and 59 which are mounted on the exterior of housing 52, and an electric motor 60 which is mounted on the exterior of housing 52. Preferably, the cylinders 53 and 54 are double rod cylinders which have load-bearing rods 63 and 64, respectively, extending from one end thereof and have non-load-bearing piston rods 67 and 68, respectively, extending from the other ends thereof. The piston rods 63 and 64 are connected by means of the pins 42B to the brackets 32A and 32B, respectively, of bucket 32. Thus, power unit 42 is relatively compact and fits conveniently with a minimum usage of space between the members 31A and 31B of stick 31.

Figure 7:
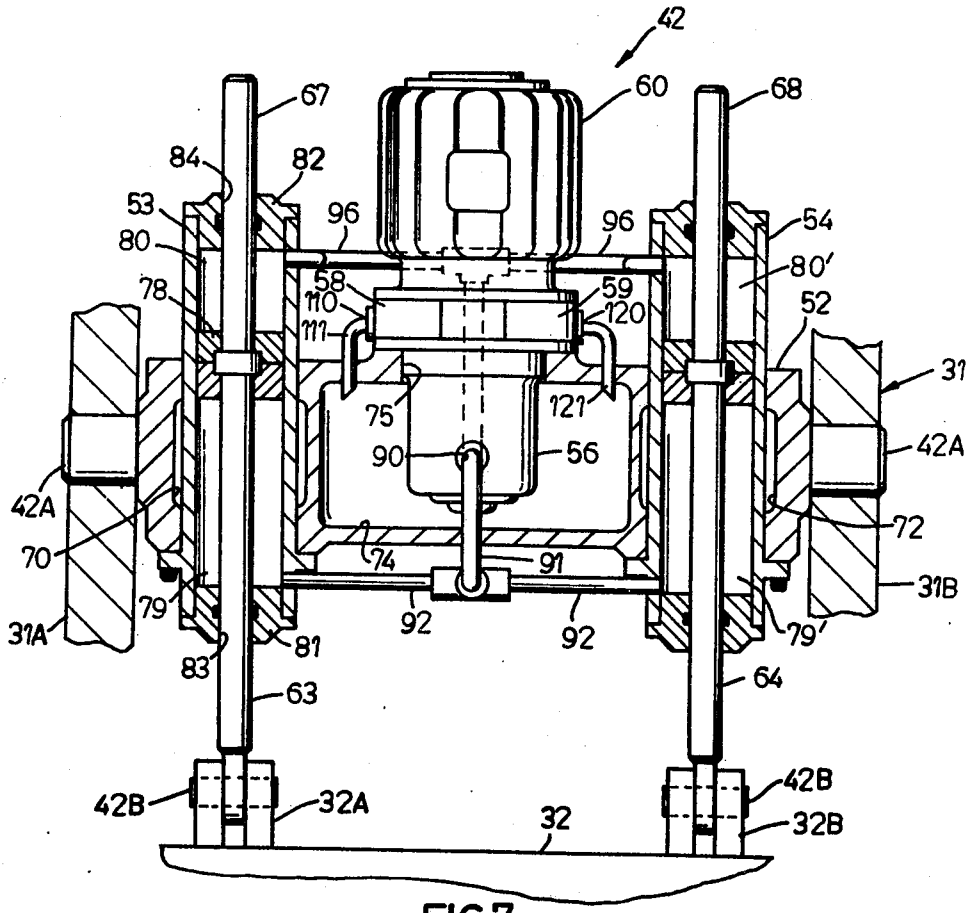
FIG. 7 is a view partly in cross section taken on line 7—7 of FIG. 2.
Figure 8:
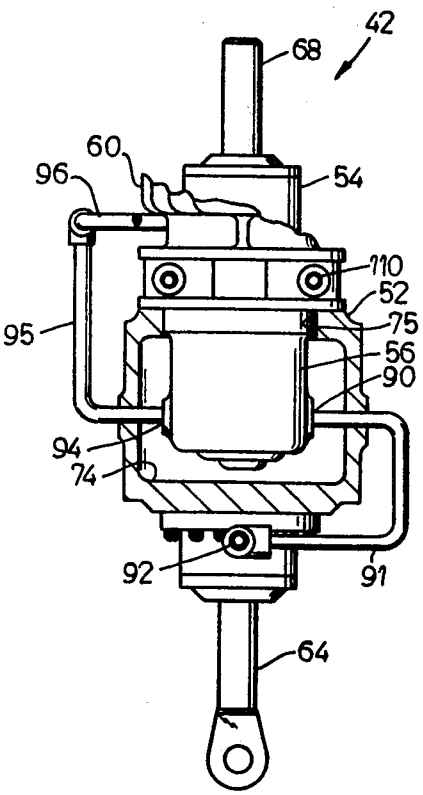
FIG. 8 is a view partly in cross section taken on line 8—8 of FIG. 5.

As FIGS. 7 and 8 best show, housing 52 comprises spaced apart generally parallel passages 70 and 72 through which the cylinders 53 and 54, respectively, extend and within which the cylinders are rigidly secured. Housing 52 also encloses or defines a chamber 74 therewithin which serves the two-fold function of accommodating main pump 56 (which extends through an opening 75 in the wall of housing 52) and serves as a hydraulic fluid reservoir, as hereinafter explained. The hydraulic cylinders 53 and 54 are identical in construction and mode of operation and, therefore, only the former is hereinafter described in detail. Cylinder 53 is a double-rod cylinder and is used in order to provide equal fluid displacement on both sides of the piston 78 which separates the chambers 79 and 80. Cylinder 53 has end walls 81 and 82 which have holes 83 and 84 therethrough for accommodating the piston rods 63 and 67, respectively. The chambers 80 and 80' of the cylinders 53 and 54, respectively, are the extend chambers of the cylinders and the chambers 79 and 79' are the retract chambers.

Figure 11:
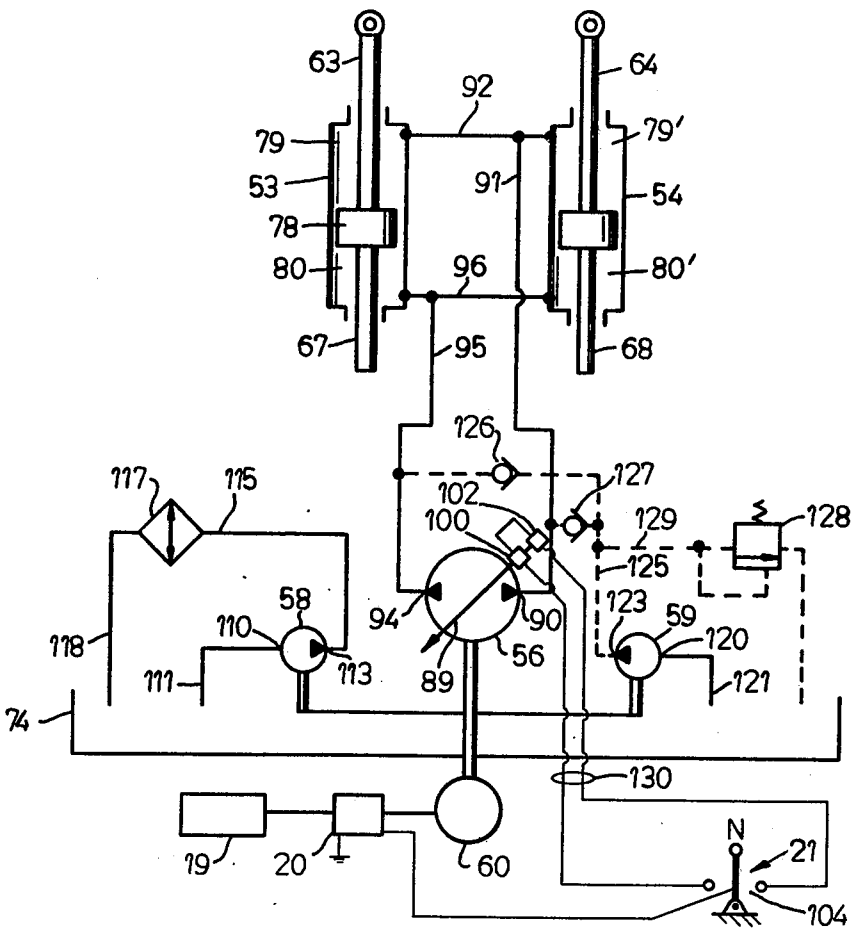
FIG. 11 is a schematic diagram of the electrical and hydraulic system of one of the power units shown in FIGS. 1–10.

Pump 56 is a reversible constant speed variable displacement-type pump having a control member 89 (shown in FIG. 11). Pump 56 has one port 90 connected by fluid lines 91 and 92 to the retract chambers 79 and 79' of the cylinders 53 and 54, respectively. Pump 56 has another port 94 connected by fluid lines 95 and 96 to the extend chambers 80 and 80' of the cylinders 53 and 54, respectively. Control member 89 is operated by means of an electrically operated extend actuator 100 and an electrically operated retract actuator 102. The actuators 100 and 102 are alternatively energizable by means of the operator's control lever 21 which actuates an electric switch 104, which switch has a neutral or open position (shown in FIG. 11) and an extend position wherein it energizes actuator 100 and a retract position wherein it energizes retract actuator 102. The actuators 100 and 102 are electrically connectable through the electric selector switch 104 to the generator 20 which also energizes electric motor 60.

Electric motor 60 also drives the low pressure pump 58 which is mounted on housing 52 of unit 42 and has its inlet port 110 connnected to reservoir 74 by supply line 111 and has its outlet port 113 connected by a supply line 115 to an oil cooler 117. The other side of oil cooler 117 is connected by fluid line 118 to reservoir 74.

Electric motor 60 also drives the low pressure fluid makeup pump 59 which has its inlet port 120 connected by a supply line 121 to fluid reservoir 74. The outlet port 123 of pump 59 is connected by a supply line 125 to main fluid line 95 and has a one-way check valve 126 therein to prevent fluid back flow from line 95 to port 125 of pump 59. A one-way check valve 127 is connected between line 125 and line 91 and prevents back flow from line 91 to port 123 of pump 59. The check valves 126 and 127 permit makeup fluid to enter the system but prevent leakage from the system. A pressure-responsive bypass valve 128 is connected in a fluid line 129 between line 125 and reservoir 74.

Figure 9:
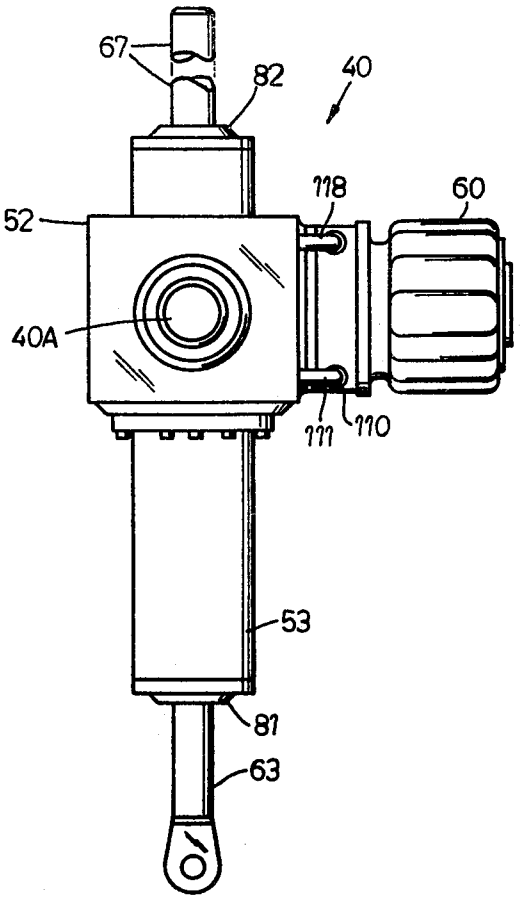
FIG. 9 is an enlarged side elevational view of another of the power units shown in FIG. 1.

In the power unit 42, the motor 60 is in axial alignment with the main pump 56 and is also in axial alignment with the cylinders 53 and 54, being disposed therebetween. The power unit 40 shown in FIGS. 1, 9, and 10, however, shows an alternative arrangement wherein the electric motor 60 is physically arranged on housing 52 so that the motor access is transverse to the plane in which the cylinders 53 and 54 lie. The ability to locate the electric motor 60 on different sides of the housing 52 enables the electric motor to be positioned in the most advantageous position possible with respect to possible interference with other components on the machine and is an important feature of the present invention. In FIG. 1, for example, the power unit 42 has the electric motor 60 disposed in the same axial arrangement as the cylinders, whereas the units 40 and 41 have their electric motor 60 disposed at right angles to their associated cylinders.

As FIG. 1 shows, an electrical connection is provided between each of the control levers 21, 24, and 26 and the electrical components, such as the actuators 100 and 102 shown in FIG. 11, on the power unit which is operated by the control lever. In FIGS. 1 and 11, the sets of conductors are designated by the numerals 130, 131, and 132.

I claim:

1. A modular electrohydraulic high fluid pressure power unit for connection between a pair of relatively movable large components and operable to effect relative movement therebetween comprising:

a housing having a chamber therein defining a fluid reservoir and a pair of spaced apart openings on opposite sides of said chamber;

a pair of hydraulic rams mounted in said openings on said housing in parallel spaced apart relationship, each ram comprising a cylinder, a piston in said cylinder, and a piston rod connected to said piston and extending from said cylinder;

means mounted on said housing and on each piston rod for connecting said power unit to said pair of relatively movable components;

a reversible hydraulic pump mounted within said chamber of said housing for supplying fluid to operate said hydraulic rams;

an electric motor mounted on said housing between said pair of rams and connected to drive said pump;

and remotely controllable means on said pump for controlling said pump.

2. A power unit according to claim 1 wherein said rams are of the double-acting equal displacement type and wherein each ram includes another piston rod connected to said piston and extending from the other end of said cylinder.

3. A power unit according to claim 1 wherein said motor has an axis which is parallel to the longitudinal axes of said rams.

4. A power unit according to claim 1 wherein said motor has an axis which is transverse to the longitudinal axes of said rams.

5. A power unit according to claim 1 further including at least one auxiliary pump mounted on the exterior of said housing and connected to be driven by said motor.

6. A power unit according to claim 5 including a fluid cooler mounted on the exterior of said housing and wherein said auxiliary pump is a fluid cooling pump connected between said reservoir and said fluid cooler.

7. A power unit according to claim 5 wherein said auxiliary pump is a fluid make-up pump connected to said reservoir for supplying make-up fluid to said rams and said reversible hydraulic pump.

8. In a large excavator;

a supporting frame;

relatively movable large components including a shovel carried by said supporting frame, each component comprising a pair of spaced apart members;

at least one modular electrohydrualic high fluid pressure power unit connected between a pair of said relatively movable components for moving one of said components;

said power unit comprising a housing having a chamber therein defining a reservoir, a pair of hydraulic rams on said housing, each of said rams comprising a cylinder and a piston rod, means on said housing and on said piston rod connected to said spaced apart member of said pair of relatively movable components;

a reversible pump mounted in said reservoir of said housing for supplying fluid to said rams, an electric motor on the exterior of said housing for driving said pump, and remotely operable means on said pump for controlling said pump;

an electric generator on said supporting frame for supplying electric power to said electric motor;

first electric cable means for supplying power from said generator to said motor;

operator control means on said supporting frame for controlling said remotely operable means on said pump;

and second means for connecting said operator control means to said remotely operable means.

9. An excavator according to claim 8 wherein said remotely operable means on said pump are electrically actuatable and wherein said second means includes electric cable means.

10. In a large excavator machine:

a supporting frame;

a prime mover mounted on said frame;

an electric generator mounted on said frame;

a plurality of relatively movable large components supported on said frame including a boom pivotally mounted on said frame;

a stick pivotally mounted on said boom;

and a bucket pivotally mounted on said stick;

each component comprising a pair of spaced apart members;

a plurality of modular self-contained independently operable electrohydraulic high fluid pressure power units for said components, each unit being located between said pair of spaced apart members of a component and comprising:

a first unit connected between said frame and said boom, a second unit connected between said boom and said stick, and a third unit connected between said stick and said bucket;

each power unit comprising:

a housing having a fluid reservoir therein;

a pair of hydraulic rams mounted in spaced apart relationship on opposite sides of said reservoir on said housing and each ram comprising a cylinder, a piston in said cylinder, and a piston rod connected to said piston and extending from said cylinder;

means mounted on said housing and on said piston rod of said ram for connecting said power unit to its associated pair of relatively movable components;

a reversible hydraulic pump mounted in said reservoir of said housing for supplying fluid to operate said hydraulic rams;

an electric motor mounted on the exterior of said housing and connected to drive said pump;

and remotely operable control means on said pump for controlling said pump;

an operator's control station on said frame;

first means including electric cables for connecting each electric motor to said generator;

second means including electric cables for connecting the remotely operable control means on each pump to said operator's control station.

11. An excavator according to claim 10 wherein said remotely operable means on said pump are electrically actuatable and wherein said second means includes electric cable means.

12. An excavator according to claim 10 wherein each component in said pair of relatively movable components comprises a pair of spaced apart members and wherein said power unit is located between said spaced apart members.

* * * * *